US011584620B1

(12) United States Patent
Lance

(10) Patent No.: US 11,584,620 B1
(45) Date of Patent: Feb. 21, 2023

(54) LIGHTWEIGHT ELEVATOR INTERIOR

(71) Applicant: E.CAB, LLC, St. Petersburg, FL (US)

(72) Inventor: Daniel Lance, St. Petersburg, FL (US)

( * ) Notice: Subject to any disclaimer, the term of this patent is extended or adjusted under 35 U.S.C. 154(b) by 0 days.

(21) Appl. No.: 17/520,937

(22) Filed: Nov. 8, 2021

(51) Int. Cl.
*B66B 11/02* (2006.01)

(52) U.S. Cl.
CPC ..... *B66B 11/0253* (2013.01)

(58) Field of Classification Search
CPC ..... B66B 11/0253; B66B 11/0226
See application file for complete search history.

(56) References Cited

U.S. PATENT DOCUMENTS

2015/0315779 A1* 11/2015 Baily ..... B32B 25/04 29/469

FOREIGN PATENT DOCUMENTS

KR 102387291 B1 * 1/2013

* cited by examiner

*Primary Examiner* — Michael A Riegelman
(74) *Attorney, Agent, or Firm* — Larson & Larson; Justin P. Miller; Frank Liebenow

(57) ABSTRACT

The lightweight elevator interior includes wall panels and a ceiling structure. In the preferred embodiment there is a layered effect created by a first applied layer of trim, partially covered by a second layer of wall panels. The thickness of the wall panels results in a front layer of laminate, and a rear layer of metal trim. The result fully hides the cab interior while maintaining the low profile of the lightweight elevator interior. The trim is preferably constructed from a reflective material, such as stainless steel. Because the trim bridges/crosses the corners of the cab interior, it is laser stitch cut, the trim shipped flat, and then bent to fit on-site. The wall panels are preferably constructed from a lightweight structural plastic panel. On one side is a decorative laminate, on the other side is a double-sided adhesive tape.

14 Claims, 21 Drawing Sheets

LIGHTWEIGHT ELEVATOR INTERIOR

FIELD

This invention relates to the field of elevator interiors and more particularly to a system to finish the interior of the elevator requiring minimal tools or fasteners.

BACKGROUND

Elevators include both mechanical elements and aesthetic, or interior, elements.

The mechanical elements allow the elevator to move between floors, open and close, and take user input. But with the exception of freight elevators, users have little contact with the mechanical elements of an elevator.

Instead, users are surrounded by paneling and lighting that covers the mechanical elements of the elevator, resulting in the user only being aware of the appealing interior, without contacting the rough, utilitarian mechanisms.

Thus, while an interior is desirable, it affects the performance of the elevator by acting as permanent cargo. An elevator has a weight limit, and every bolt and nut added beyond the mechanical elements reduces the weight of passengers, luggage, and cargo that the elevator can safely carry.

Elevator interiors are typically constructed from thick, dense materials, such as ¾" thick medium-density fiberboard, that is hung against the wall and ceiling using Z-clips and threaded rods.

Ceilings, for example, are typically too heavy to be lifted by hand, instead requiring winches to lift into place.

Furthermore, each installation is custom, with panels cut to fit and installed on-site over the course of several days.

The resulting system is costly due to material consumption, custom installation, and added 1,500 pounds to an elevator.

As elevators have become simpler and more compact, there has emerged a need for lighter interiors to increase load available for passengers and cargo.

What is needed is a lightweight, east-to-install elevator interior.

SUMMARY

The lightweight elevator interior includes wall panels and a ceiling structure.

In the preferred embodiment there is a layered effect created by a first applied layer of trim, partially covered by a second layer of wall panels. The thickness of the wall panels results in a front layer of laminate, and a rear layer of metal trim. The result fully hides the cab interior while maintaining the low profile of the lightweight elevator interior.

The trim is preferably constructed from a reflective material, such as stainless steel. Because the trim bridges/crosses the corners of the cab interior, it is stitch cut—an intermittent cut akin to perforation—allowing the trim to be shipped flat, and then readily bent to fit on-site.

The wall panels are preferably constructed from a lightweight structural plastic panel. On one side is a decorative laminate, on the other side is a double-sided adhesive tape.

The panels are pre-cut—cut-to-size at the factory—to fit the layout of the particular elevator cab.

To install, the backing of the adhesive tape is removed, the panel applied to a clean surface of the interior of the elevator cab.

To ensure proper placement and a consistent appearance, a collection of temporary spacers is supplied with the wall panels. The temporary spacers are placed against reference surfaces within the cab. For example, the floor or interior corners.

Wall panels are then placed against the cab interior, resting against the temporary spacers.

The temporary spacers are then moved, now referencing the first installed panel. The second panel is then placed, and the temporary spacers are again moved.

This process is repeated until installation of the wall panels is complete.

The ceiling is constructed using a different methodology because it must be separated from the ceiling of the elevator interior to allow space for lighting, and includes removable sections to allow an occupant, or safety personnel, to reach the emergency access hatch.

The ceiling panel is constructed as an assembly, the assembly clipped to the ceiling of the cab, and then rotated into place. This method is safer than lifting a heavy panel up to threaded rods, and is more readily accessible for maintenance.

Additionally, after being clipped, but before being rotated into place, the installer can finish the installation of the lighting and associated electronics. Later, the ceiling assembly can be rotated downward for maintenance of the lighting system, such as bulb replacement or cleaning of the fixtures.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
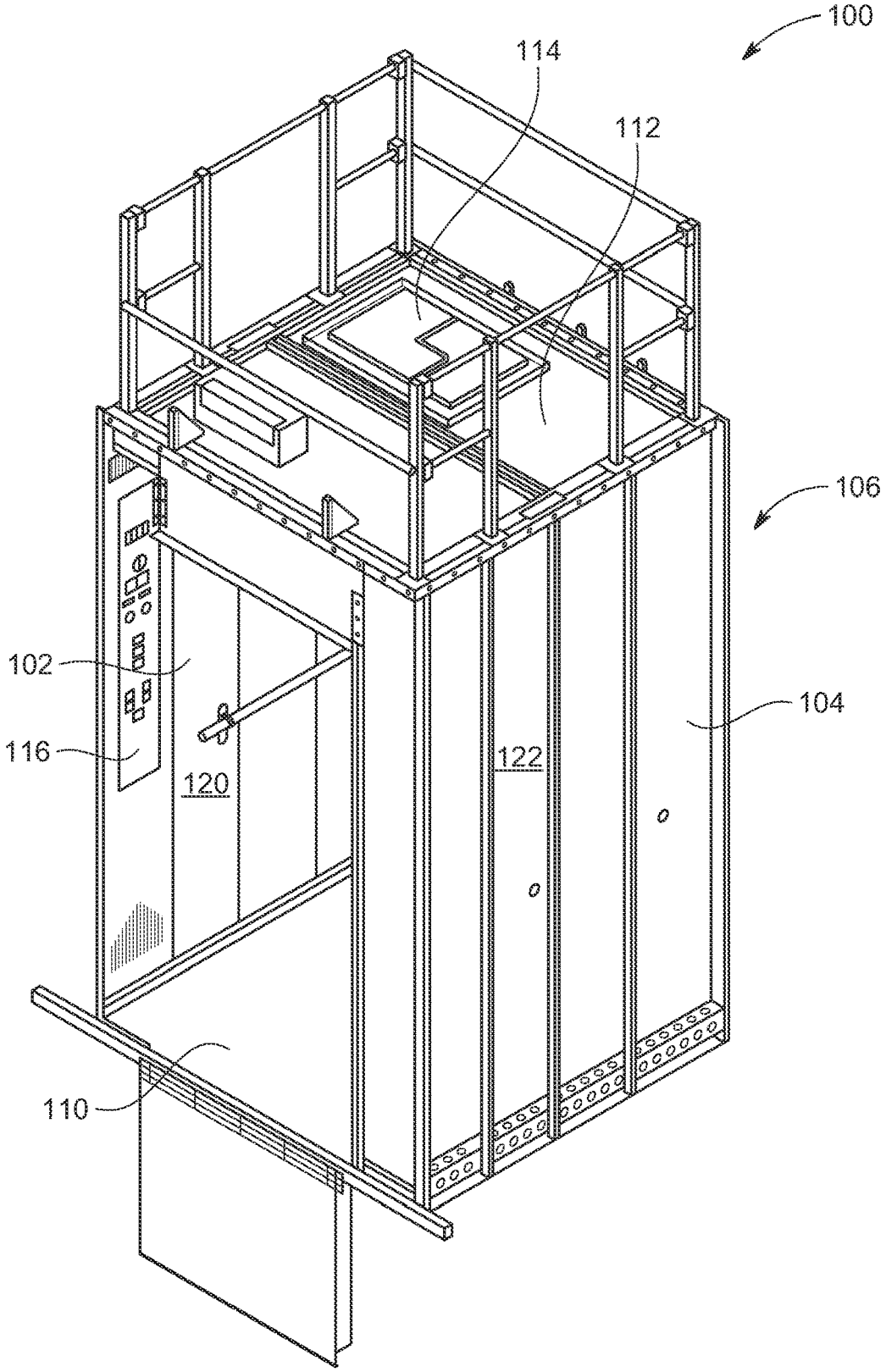
FIG. 1 illustrates a typical elevator cab into which the lightweight elevator interior would be installed.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a typical elevator cab into which the lightweight elevator interior would be installed is shown.

A typical elevator cab 100 includes a left cab wall 102, right cab wall 104, back cab wall 106, cab floor 110, and cab ceiling 112.

The cab ceiling 112 includes an emergency trap door 114.

The operating panel 116 allows a user to control elevator operation.

A handrail 118 provides a grip for a user.

Generally, every cab wall has a cab wall interior surface 120 and a cab wall exterior surface 122. The lightweight elevator interior is installed against the cab wall interior surface 120.

Figure 2:
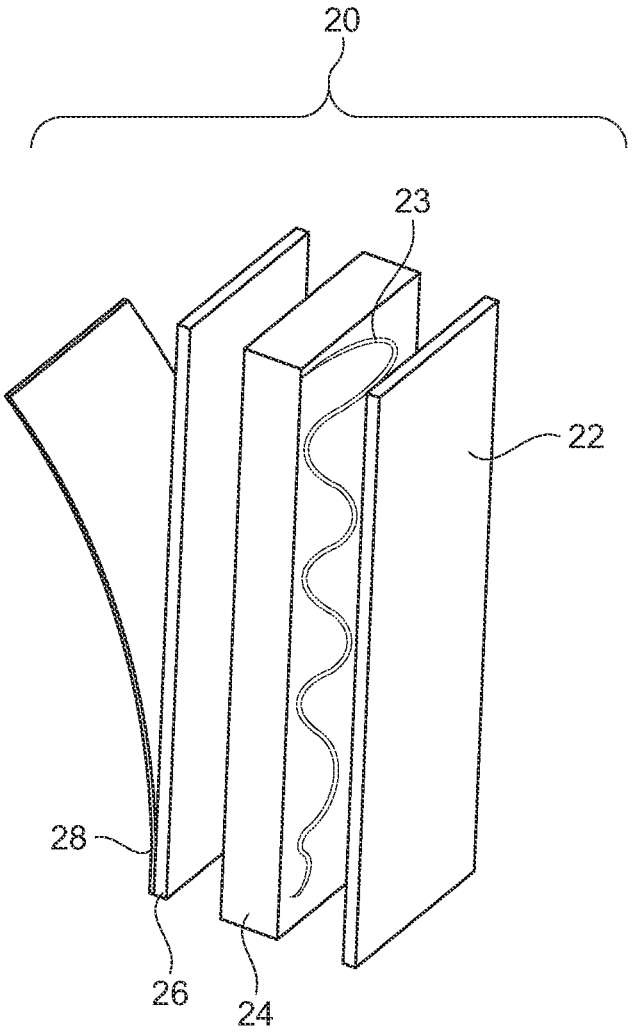
FIG. 2 illustrates a cross-section of the typical wall panels of the lightweight elevator interior.

Referring to FIG. 2, a cross-section of the typical wall panels of the lightweight elevator interior is shown.

A typical wall panel 20 includes a layer of laminate 22 affixed to a plastic sheet 24 using an adhesive 23.

A double-sided adhesive tape 26 is affixed to the opposing face of the plastic sheet 24, with a removable backing 28.

Figure 3:
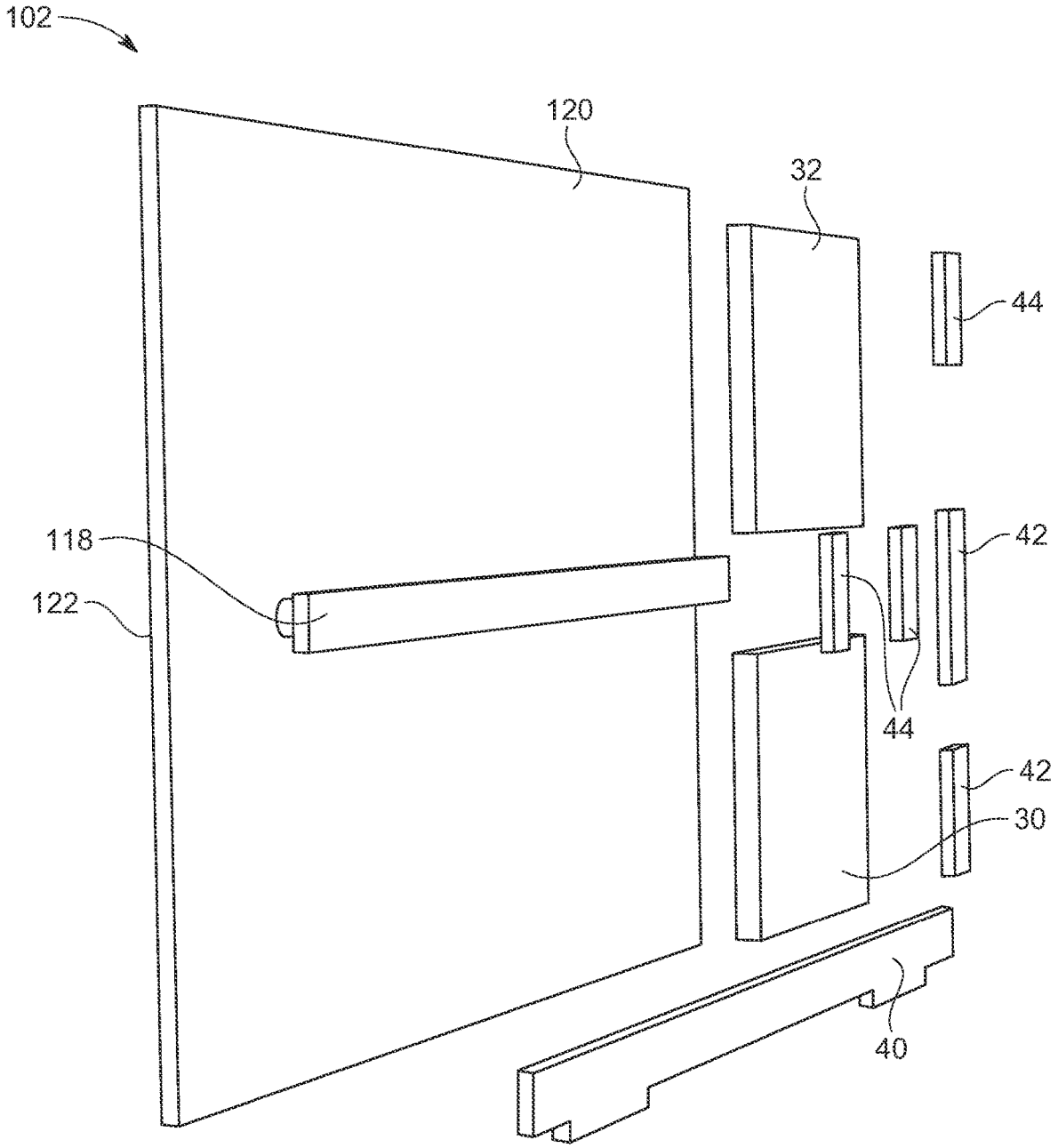
FIG. 3 illustrates a schematic view, before placement of any wall pieces.

Referring to FIG. 3, a schematic view, before placement of any wall pieces is shown.

The left cab wall 102 as an example of an interior wall. A handrail 118 is shown affixed to the cab wall interior surface 120, the handrail 118 supplied with the mechanical elements of the elevator.

The cab wall exterior surface 122 is shown for orientation.

If the elevator was to receive trim elements, these would be placed first, before placement of the wall panels.

The selection of temporary elements required to begin installation of wall panels is shown, including a base spacer 40, reveal spacer 42, and handrail spacer 44.

The wall panels include lower wall panel 30 and upper wall panel 32.

Figure 4:
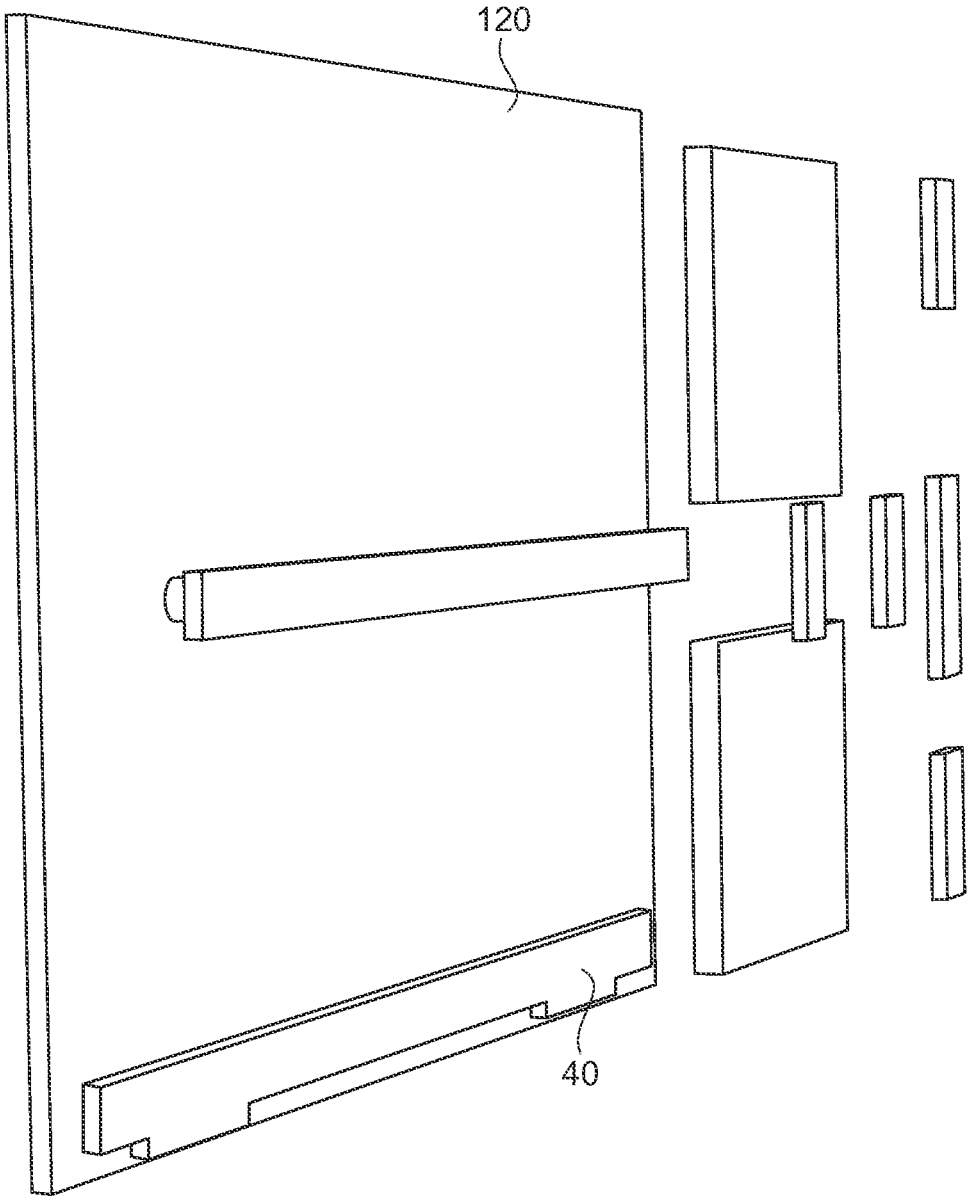
FIG. 4 illustrates a schematic view after placement of the base spacer.

Referring to FIG. 4, a schematic view after placement of the base spacer is shown.

Figure 6:
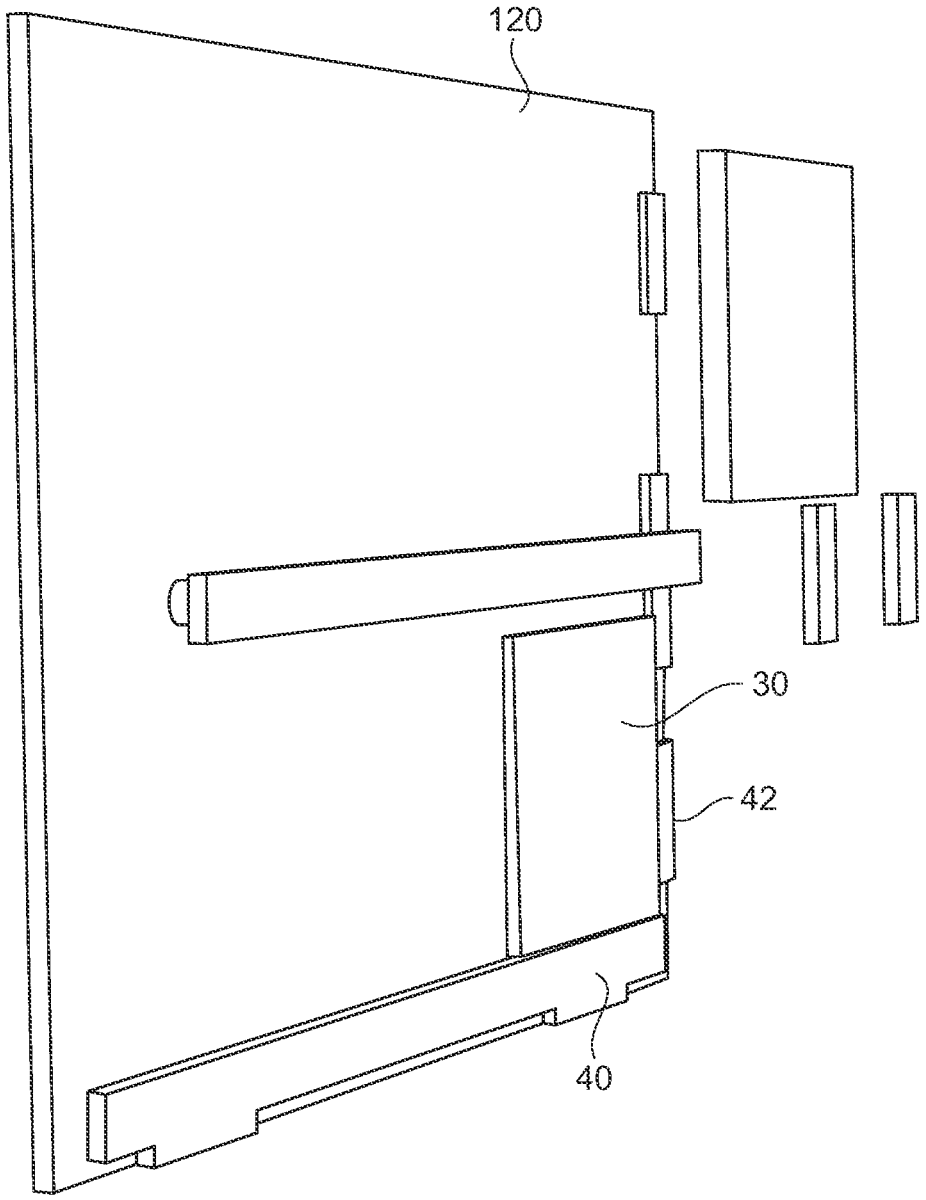
FIG. 6 illustrates a schematic view after placement of the first panel.

The base spacer 40 is placed first against the cab wall interior surface 120, creating a vertical separating for placement of wall panels (see FIG. 6).

Figure 5:
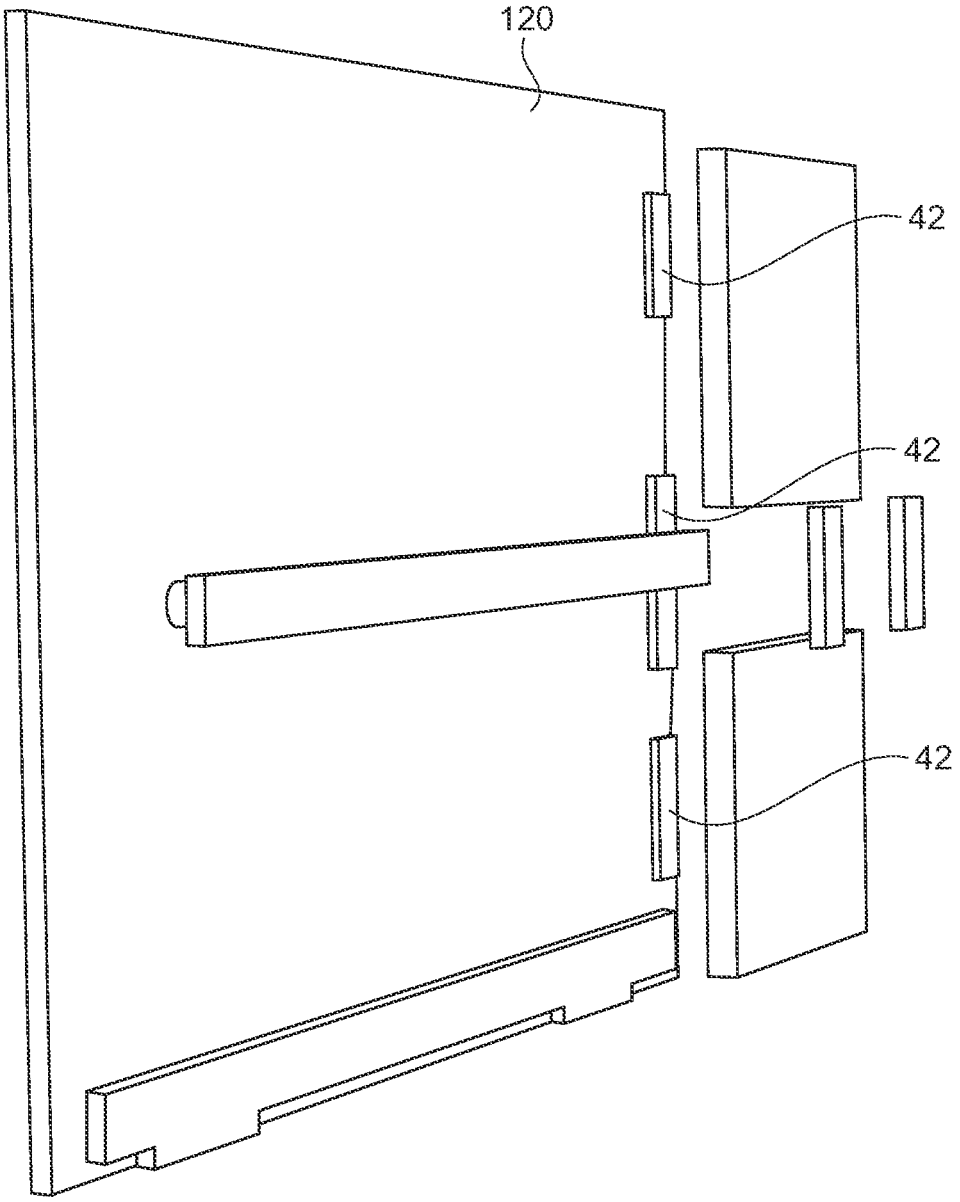
FIG. 5 illustrates a schematic view after placement of the first set of reveal spacers.

Referring to FIG. 5, a schematic view after placement of the first set of reveal spacers is shown.

The reveal spacers 42 are next placed against the cab wall interior surface 120, creating a horizontal separation for placement of wall panels (see FIG. 6).

Referring to FIG. 6, a schematic view after placement of the first panel is shown.

The lower wall panel 30 is then placed. To place the lower wall panel 30, the backing is removed from the double-sided adhesive. The lower wall panel 30 is then aligned with the base spacer 40 and reveal spacer 42, then pressed into place against the cab wall interior surface 120.

Figure 7:
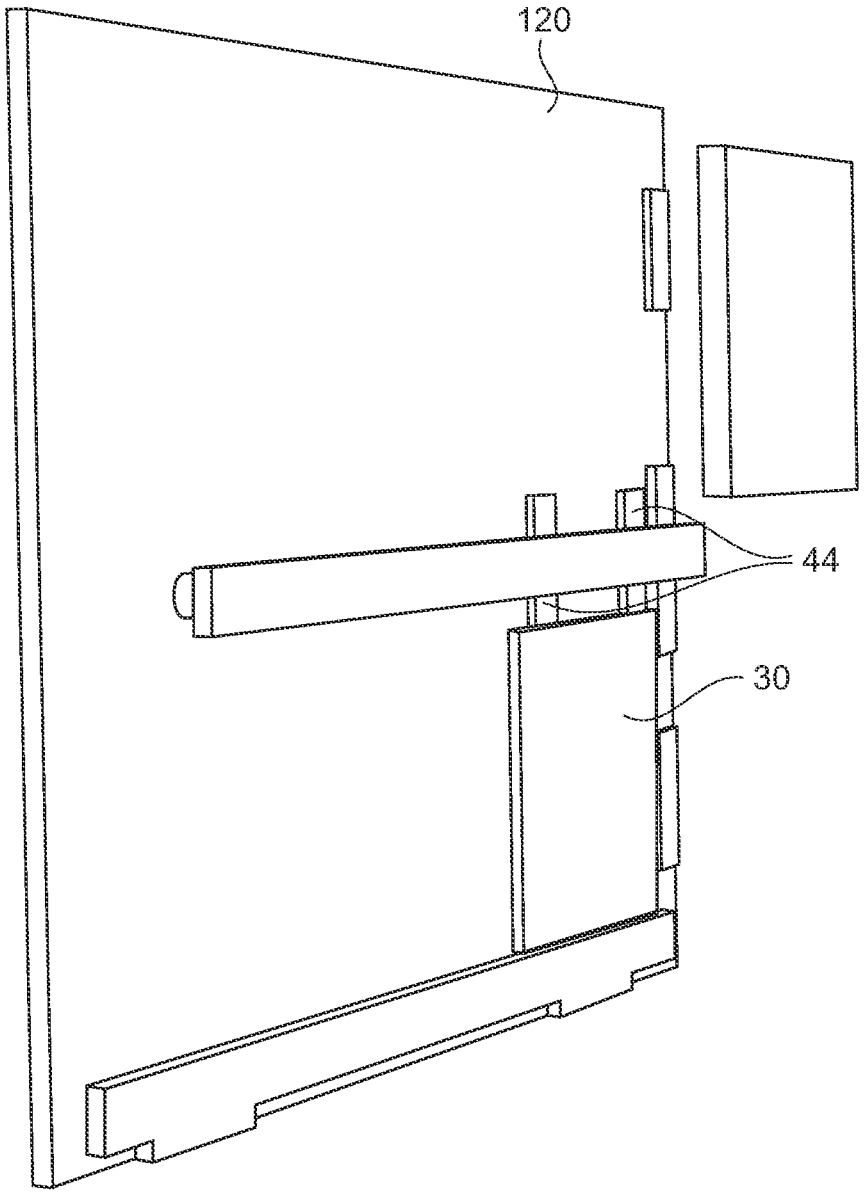
FIG. 7 illustrates a schematic view after placement of the handrail spacers.

Referring to FIG. 7, a schematic view after placement of the handrail spacers is shown.

The handrail spacers 44 are placed, resting against the installed lower wall panel 30.

Figure 8:
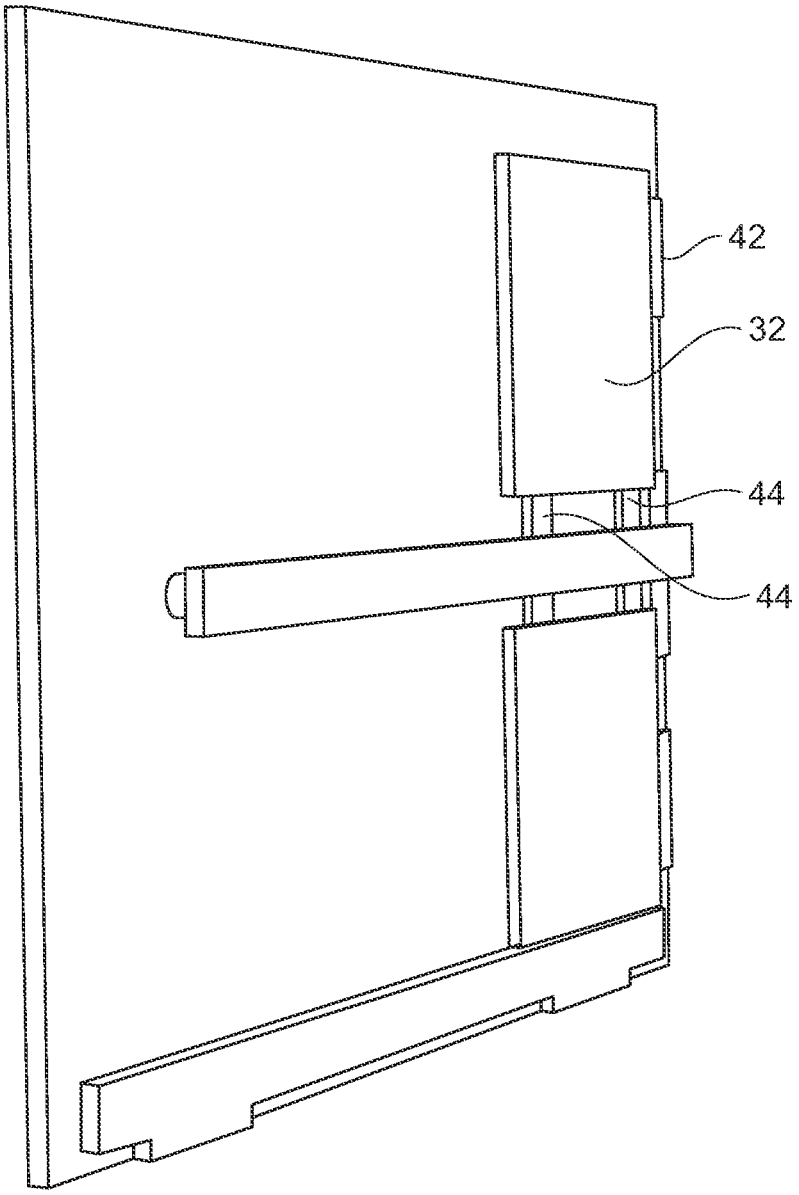
FIG. 8 illustrates a schematic view after placement of the second panel.
Figure 9:
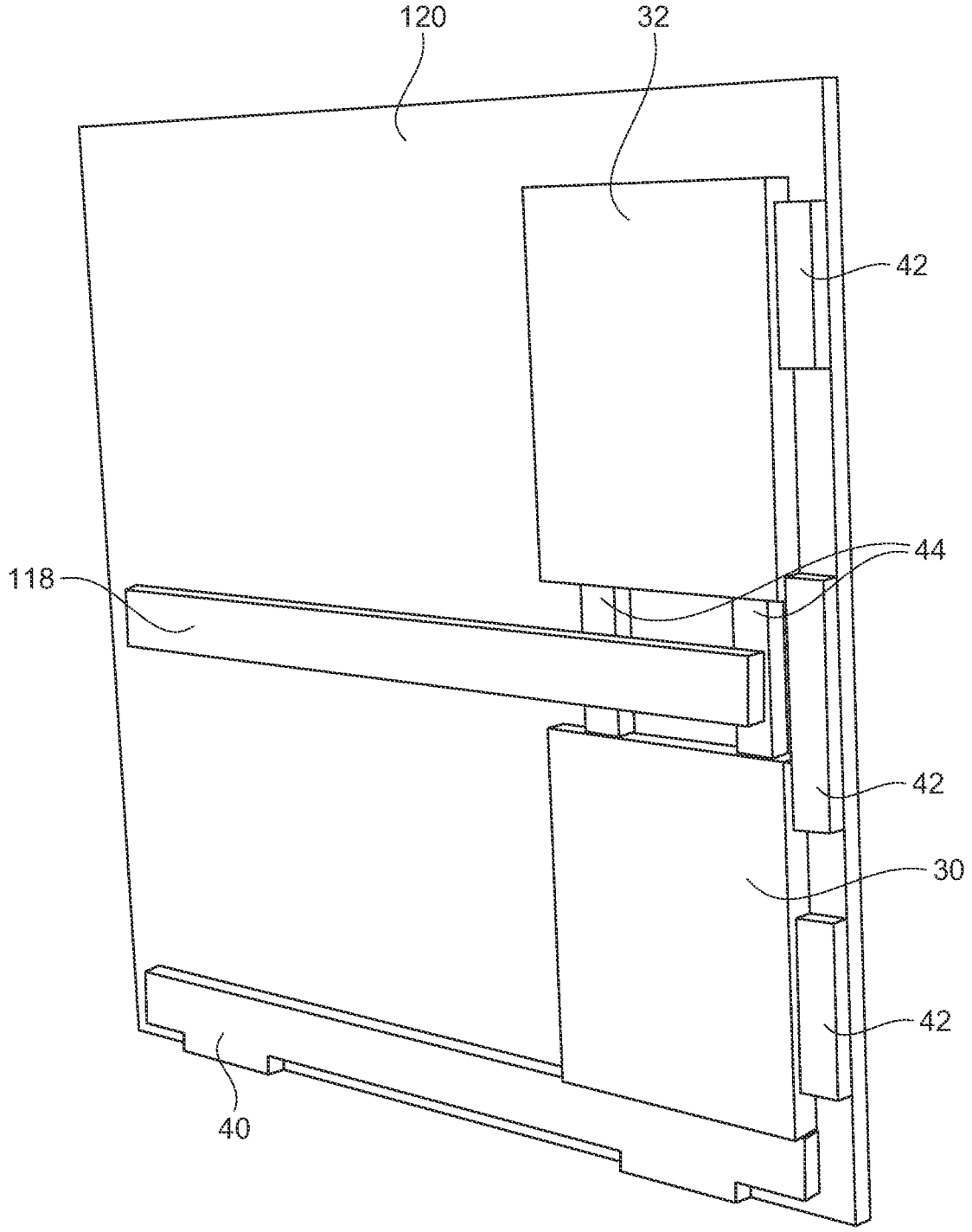
FIG. 9 illustrates a second schematic view after placement of the second panel.
Figure 10:
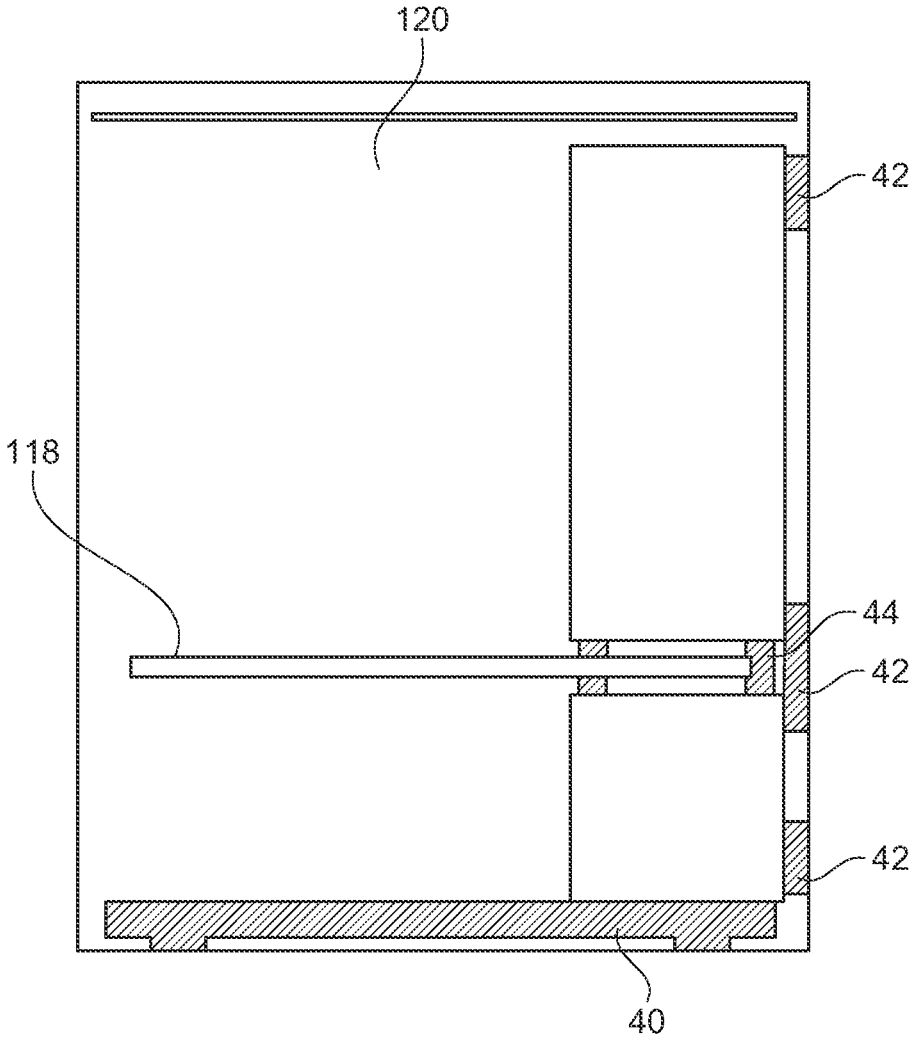
FIG. 10 illustrates a third schematic view after placement of the second panel.

Referring to FIGS. 8, 9, and 10, schematics views after placement of the second panel are shown.

The upper wall panel 32 is placed against the reveal spacer 42 and the handrail spacer 44.

Again shown are base spacer 40, reveal spacer 42, and handrail spacer 44, guiding the placement of lower wall panel 30 and upper wall panel 32.

Figure 11:
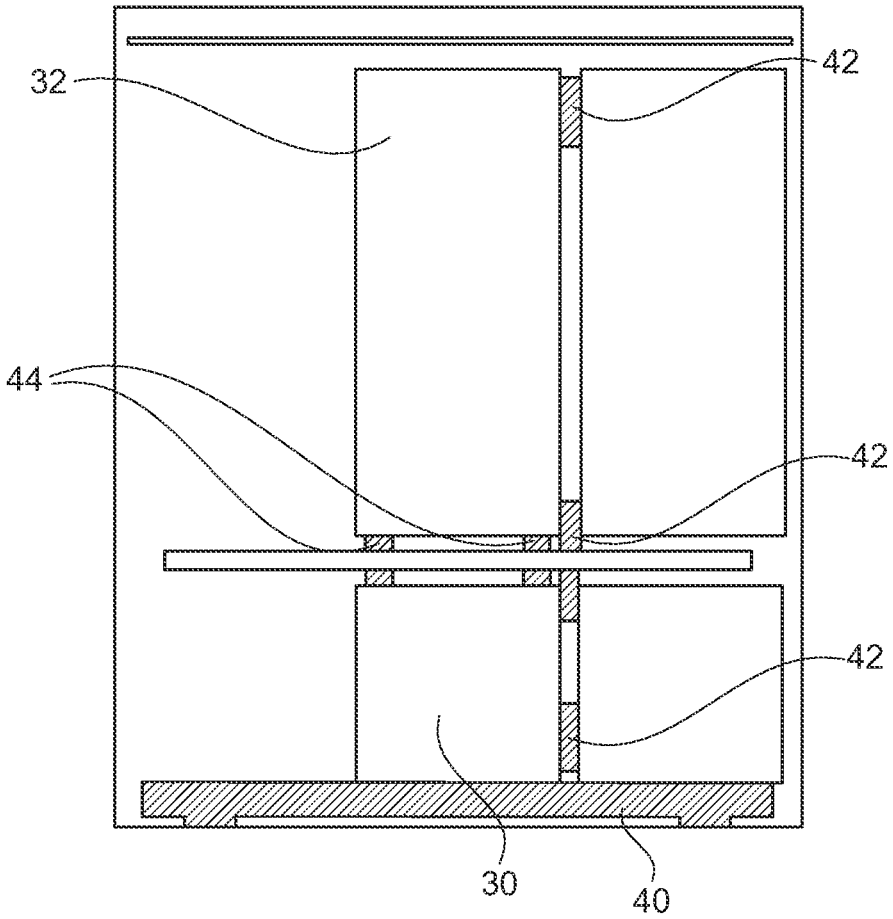
FIG. 11 illustrates a schematic view after the handrail and reveal spacers have been moved, and additional panels placed.

Referring to FIG. 11, a schematic view after the handrail and reveal spacers have been moved, and additional panels placed is shown.

The base spacer 40 remains in place, with the reveal spacers 42 and handrail spacers 44 moved over, guiding placement of the lower wall panel 30 and the upper wall panel 32.

Figure 12:
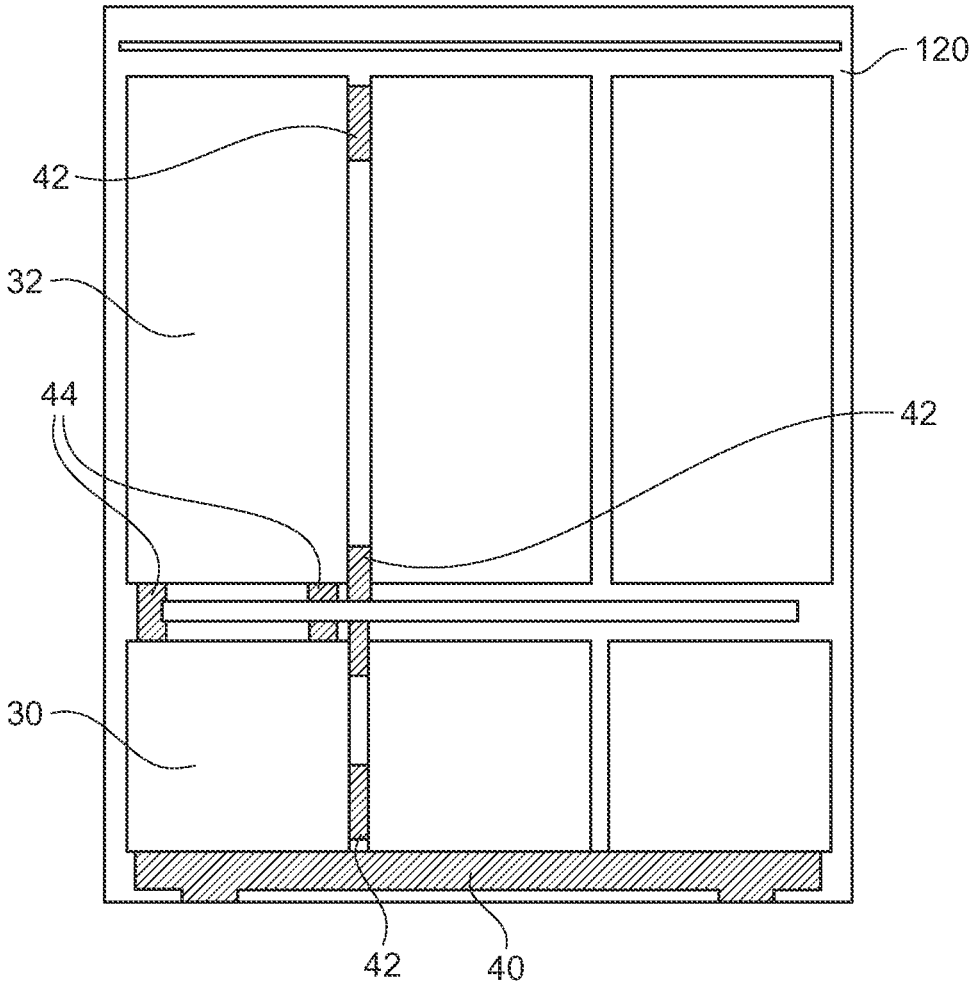
FIG. 12 illustrates a schematic view after the handrail and reveal spacers have been moved again, and additional panels placed of the lightweight elevator interior.

Referring to FIG. 12, a schematic view after the handrail and reveal spacers have been moved again, and additional panels placed of the lightweight elevator interior is shown.

Again, the base spacer 40 remains in place, with the reveal spacers 42 and handrail spacers 44 moved over, guiding placement of the lower wall panel 30 and the upper wall panel 32.

With the wall panels 40/42 all in place, the spacers 40/42/44 are all removed.

Figure 13:
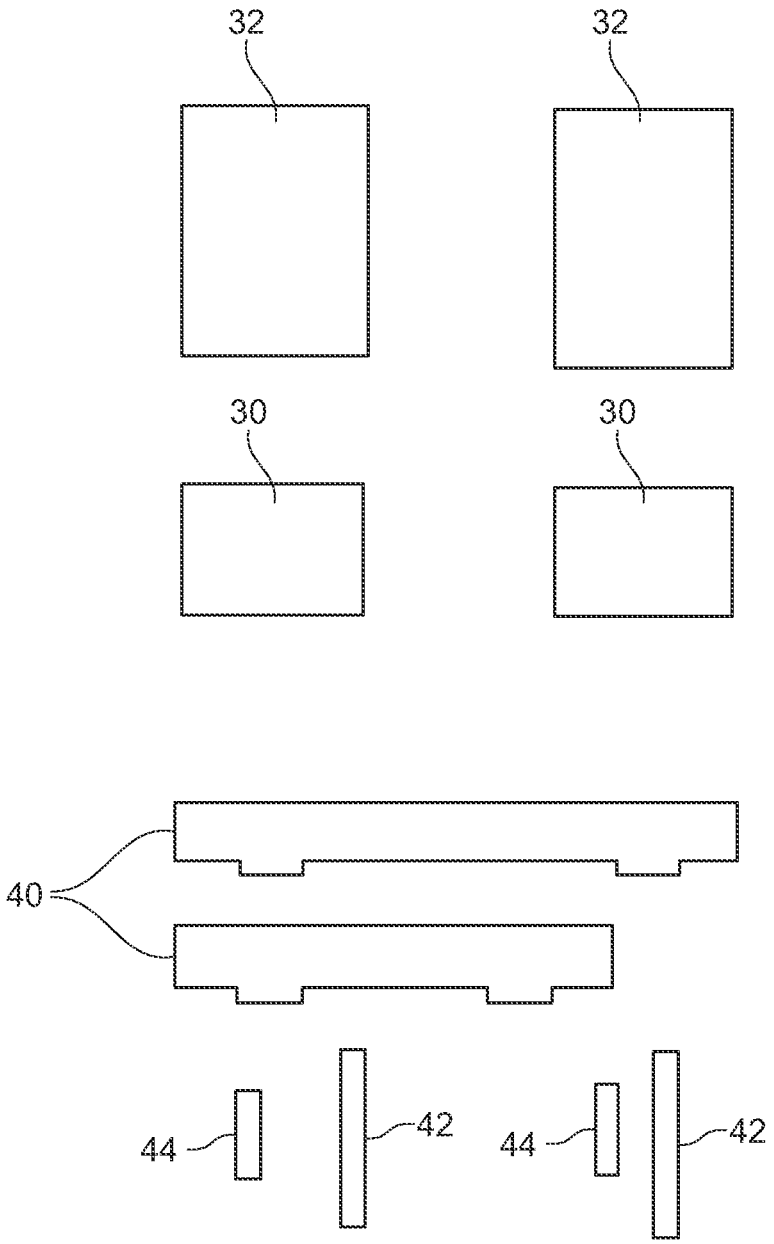
FIG. 13 illustrates a collection of items from a typical kit for the wall panels of the lightweight elevator interior.

Referring to FIG. 13, a collection of items from a typical kit for the wall panels of the lightweight elevator interior is shown.

Included are the lower wall panels 30, upper wall panels 32, base spacer 40, reveal spacer 42, and handrail spacer 44.

Figure 14:
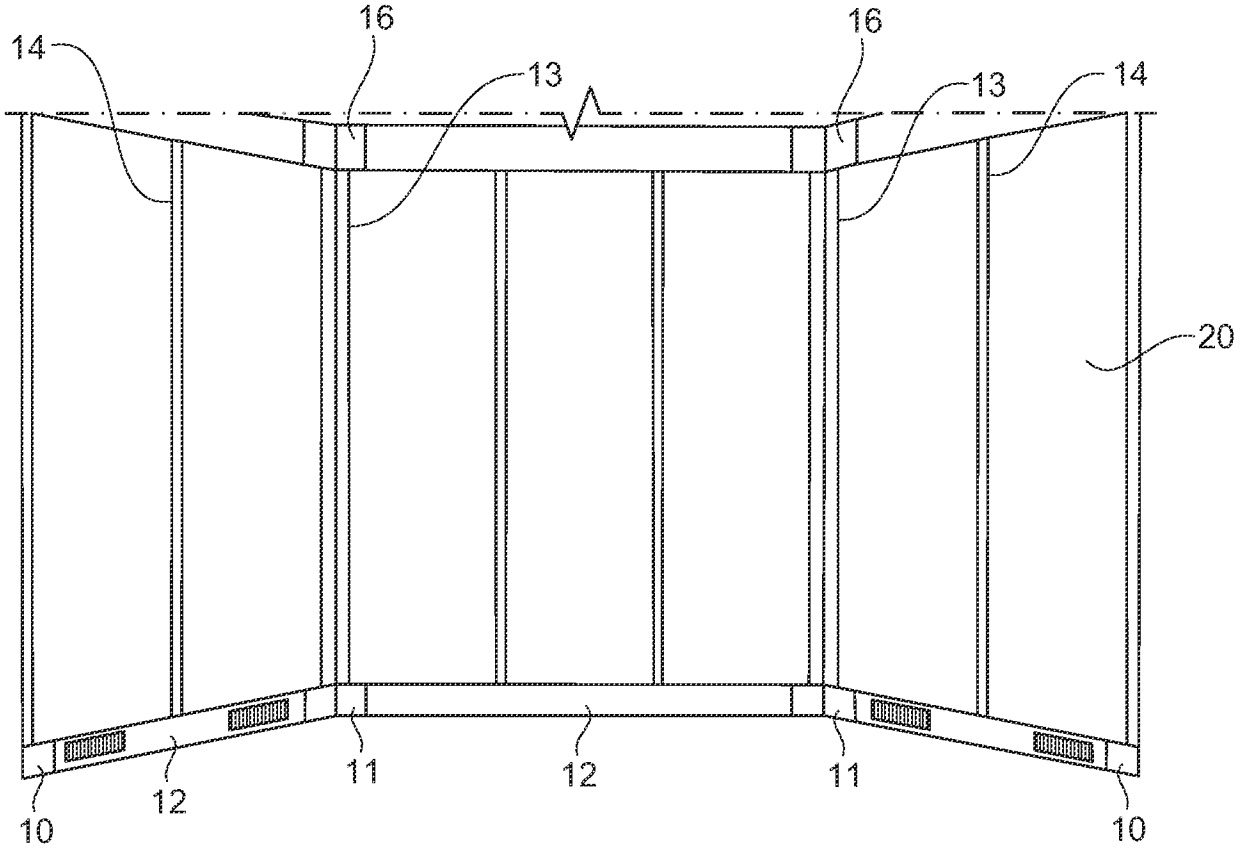
FIG. 14 illustrates a view of the installed panels and trim of the lightweight elevator interior.
Figure 15:
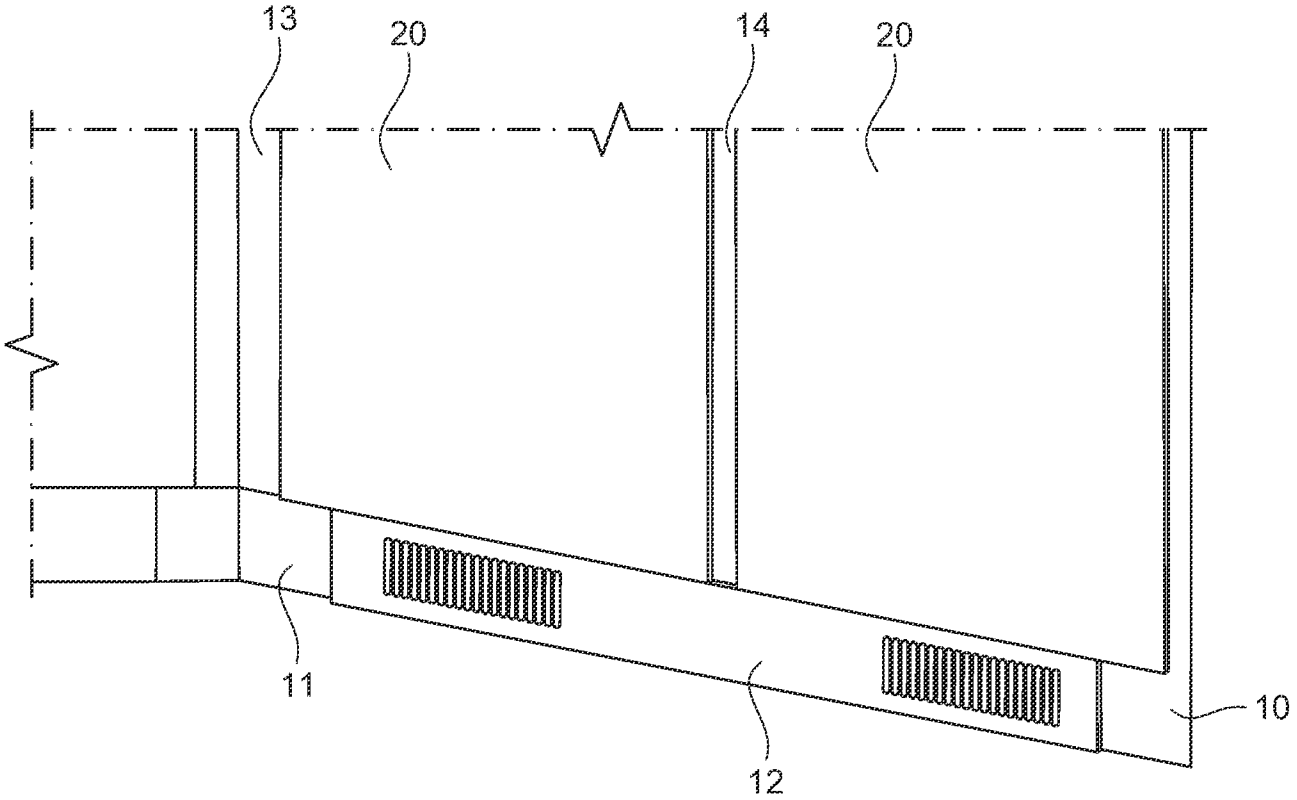
FIG. 15 illustrates a view of the base trim of the lightweight elevator interior.

Referring to FIGS. 14 and 15, views of the installed panels and trim of the lightweight elevator interior are shown.

As discussed above, when trim pieces are used, the order of placement is important.

Generally, placement is bottom-to-top, and back-to-front.

Thus, first placed are the base trim 10 and the base corner trim 11.

This is followed by corner reveal trim 13 and wall reveal trim 14, which will be partially covered by the wall panels 20.

Next is base main trim 12, which will cover the bottom end of the corner reveal trim 13 and wall reveal trim 14.

Then the wall panels 20 are applied from one end to the other, for example, from right to left. Spacers are used as discussed above to ensure proper placement.

The ceiling corner trim 16 is placed against the top of the wall panels 20.

Figure 16:
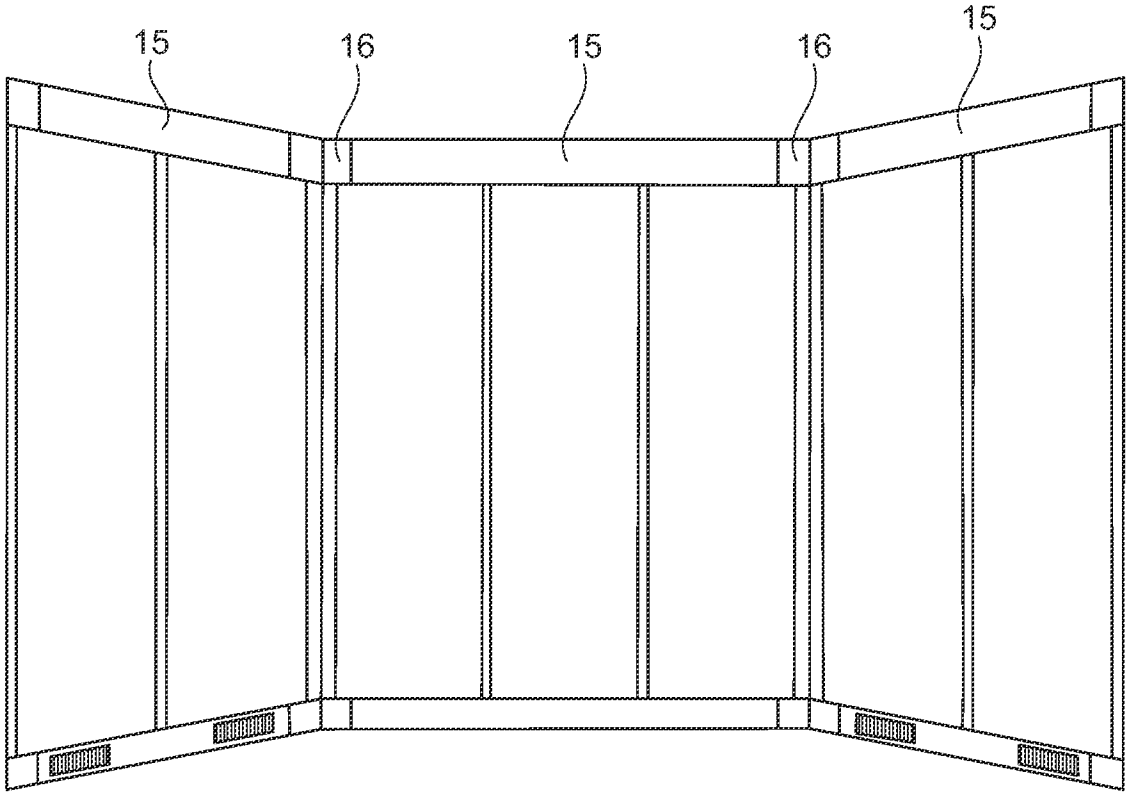
FIG. 16 illustrates a view after installation of the ceiling trim of the lightweight elevator interior.

Referring to FIG. 16, a view after installation of the ceiling trim of the lightweight elevator interior is shown.

Finally, the ceiling perimeter trim 15 and ceiling corner trim 16 are placed, completing installation.

Figure 17:
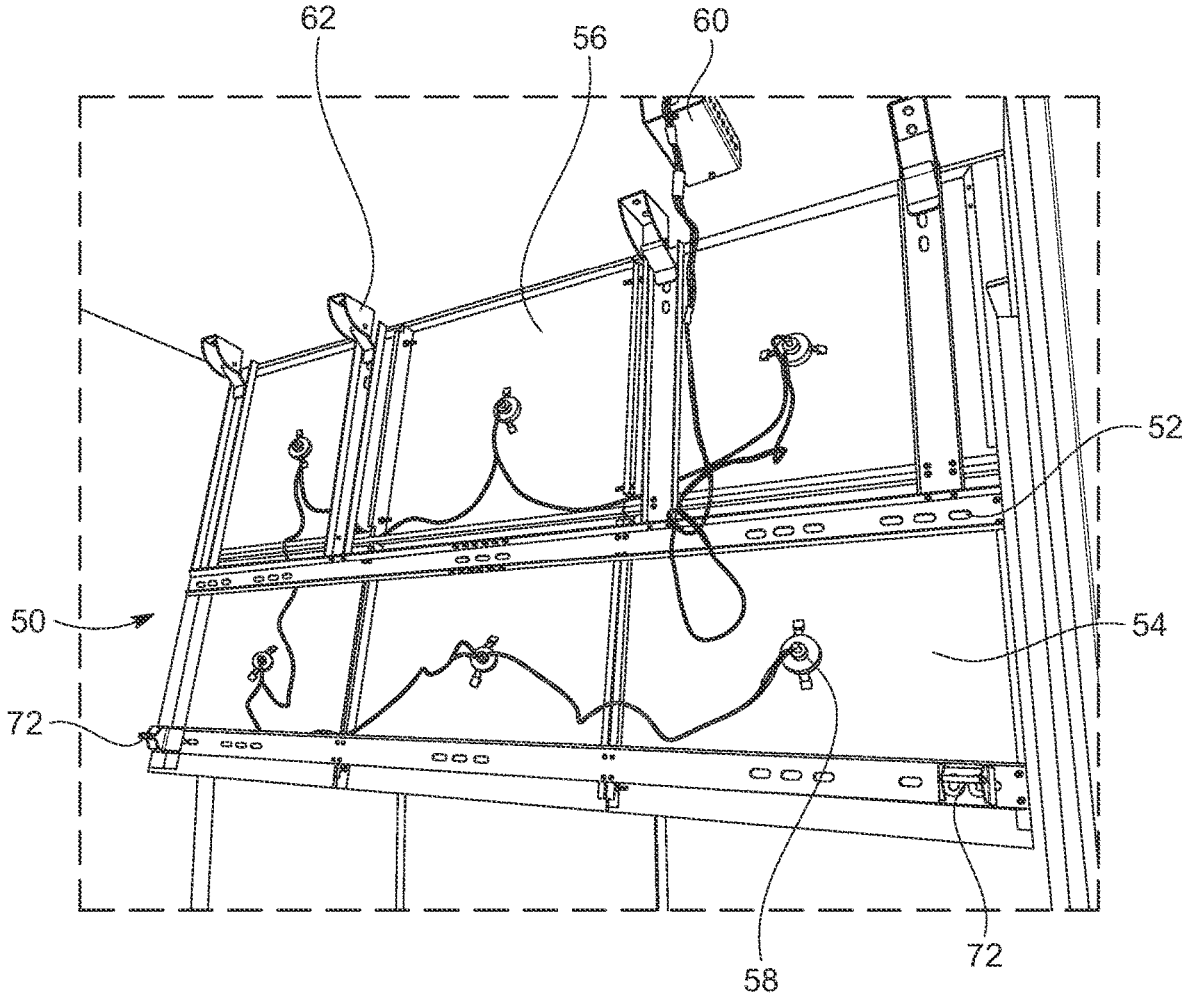
FIG. 17 illustrates a view of the ceiling structure, assembled and hooked, prior to rotation into place of the lightweight elevator interior.

Referring to FIG. 17, a view of the ceiling structure, assembled and hooked, prior to rotation into place of the lightweight elevator interior is shown.

The ceiling 50 is shown with ceiling structure 52 supporting the ceiling panels 54. An escape hatch pass-through 56 allows for access to the emergency trap door 114 of the elevator cab 100 (see FIG. 1).

Lighting 58 is installed within the panels 54, connected to the transformer 60.

A set of rear hinges 62 allows the ceiling 50 to be hung while installation is completed. The ceiling 50 will then be rotated into place, the front catches 68 (see FIG. 21) with pins 72 locking into latches 70 (see FIG. 21) to hold the ceiling 50 in its final position.

Figure 18:
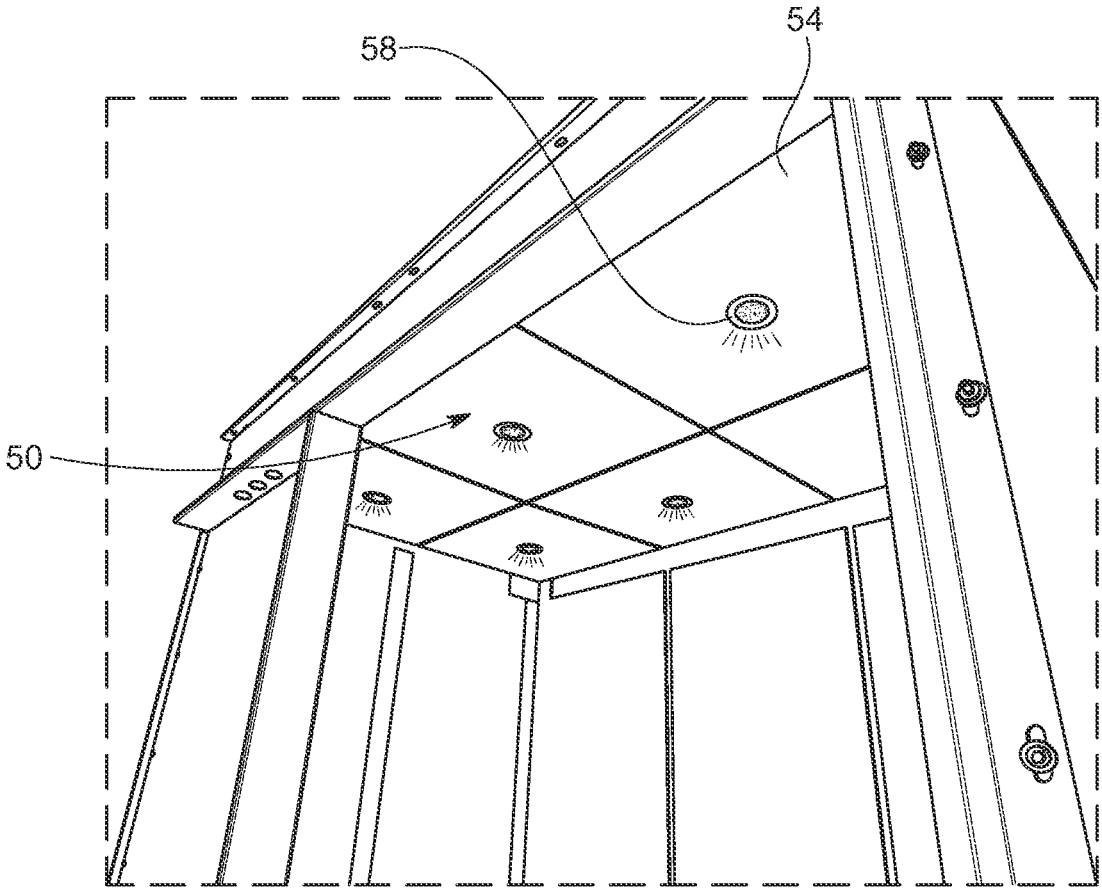
FIG. 18 illustrates a view of the ceiling structure after rotation into place of the lightweight elevator interior.

Referring to FIG. 18, a view of the ceiling structure after rotation into place of the lightweight elevator interior is shown.

The ceiling 50 has been rotated into place, leaving only the ceiling panels 54 and lighting 58 visible.

Figure 19:
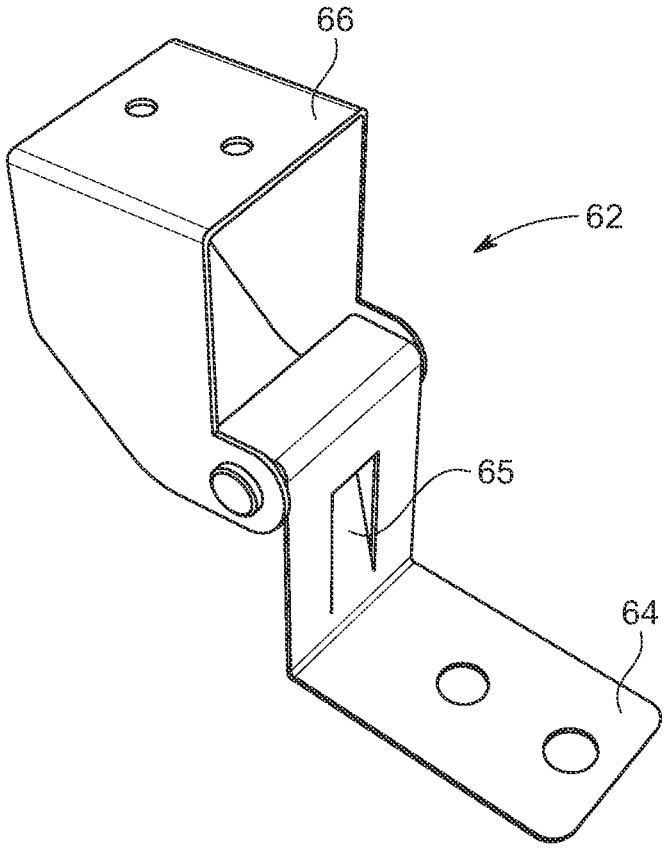
FIG. 19 illustrates a rear hinge of the lightweight elevator interior.
Figure 20:
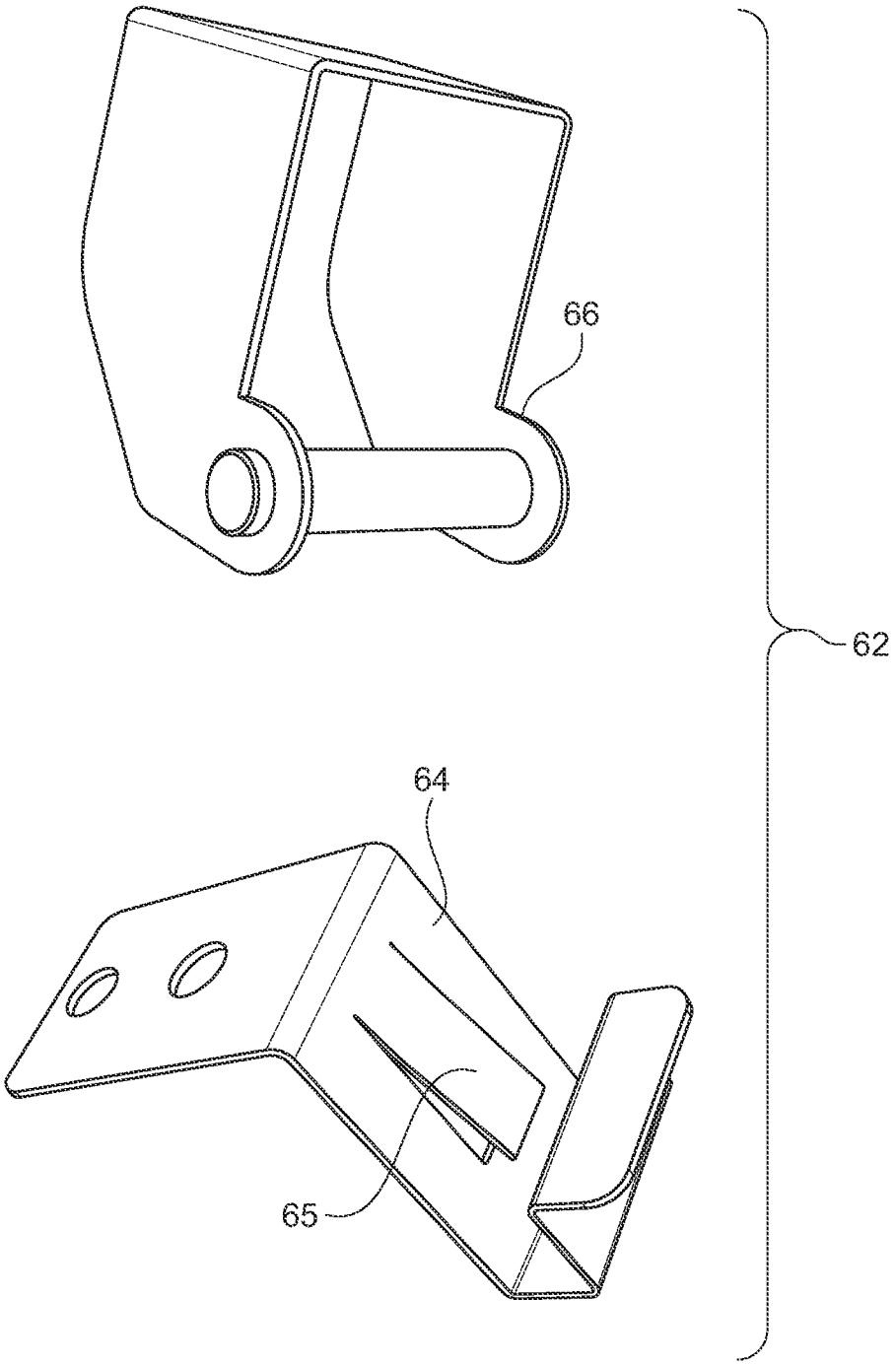
FIG. 20 illustrates an exploded view of a rear hinge of the lightweight elevator interior.

Referring to FIGS. 19 and 20, a rear hinge of the lightweight elevator interior is shown.

The rear hinges 62 are made up of the hinge clip 64 and hinge pin 66, locked in place using the catch 65.

Figure 21:
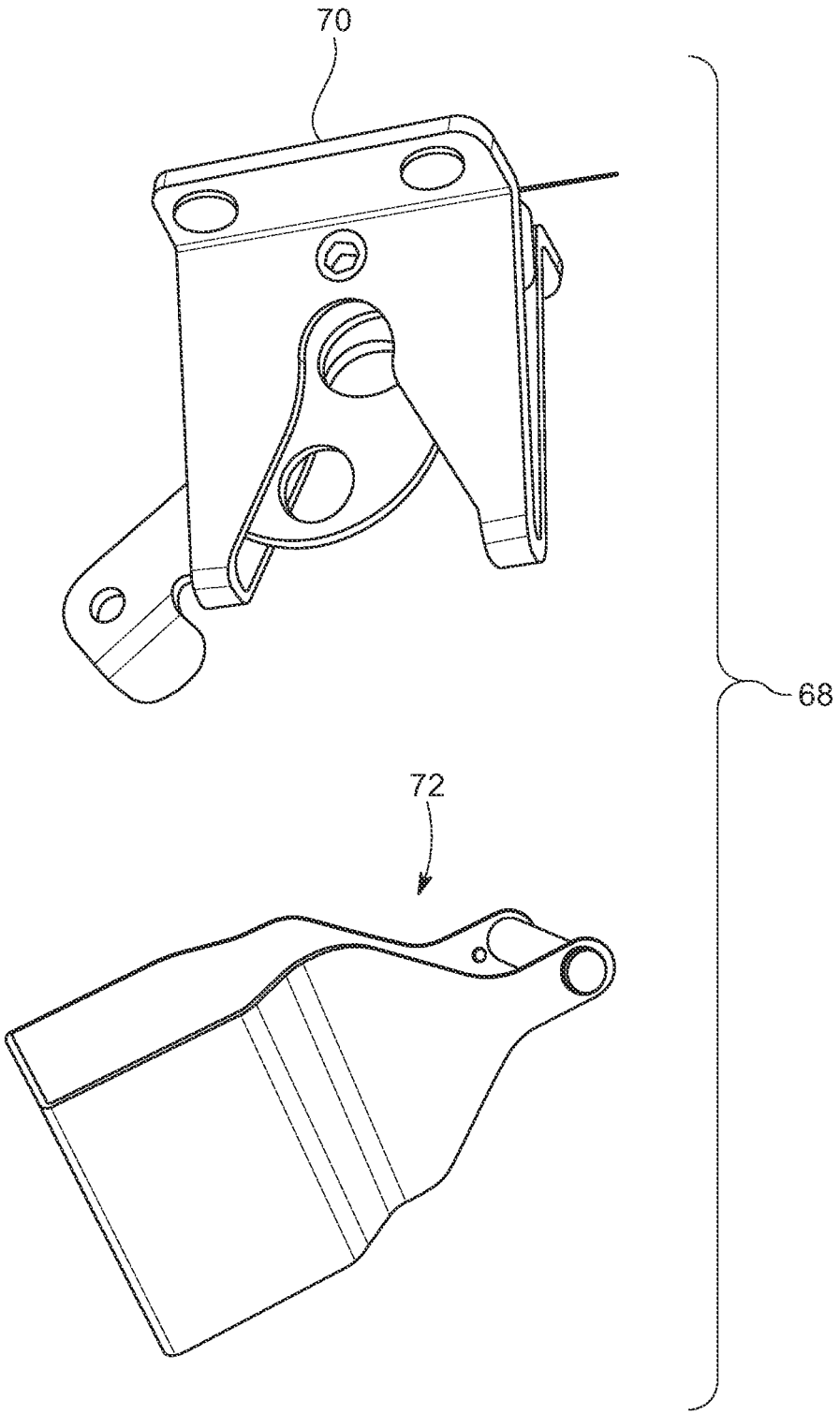
FIG. 21 illustrates a partially exploded view of the front catch of the lightweight elevator interior.

Referring to FIG. 21, a partially exploded view of the front catch of the lightweight elevator interior is shown.

The front catches 68 include a latch 70 and a pin 72.

Equivalent elements can be substituted for the ones set forth above such that they perform in substantially the same manner in substantially the same way for achieving substantially the same result.

It is believed that the system and method as described and many of its attendant advantages will be understood by the foregoing description.

It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A system to create a lightweight elevator interior within an elevator cab, the elevator cab including interior walls that meet a floor at a base corner, the interior walls meeting each other at a wall corner, the system comprising:

a collection of individual wall panels, each individual wall panel comprising:

a structural plastic sheet placed between a layer of laminate and a layer of double-sided adhesive;

a collection of temporary spacers, the collection of temporary spacers including:

a base spacer for vertically separating the collection of individual wall panels from the base corner and the wall corner;

a reveal spacer for horizontally separating individual wall panels of the collection of individual wall panels from each other;

a handrail spacer for vertically separating individual wall panels of the collection of individual wall panels from each other;

whereby an installer uses the collection of temporary spacers to locate the collection of individual wall panels across the interior walls of the elevator cab, the collection of temporary spacers then removed.

2. The system to create a lightweight elevator interior of claim 1, further comprising:

a ceiling structure that supports one or more ceiling panels;

the one or more ceiling panels including an escape hatch pass-through;

the ceiling structure connected to a ceiling of the elevator cab using one or more hinges;

the ceiling structure removably latching to the ceiling using one or more latches, a user able to release the one or more latches, allowing the ceiling structure to rotate downward for installation and service.

3. The system to create a lightweight elevator interior of claim 1, wherein each individual wall panel of the collection of individual wall panels is cut-to-size in advance, before shipment to a location of elevator cab, thus allowing an installer to place each individual wall panel of the collection of individual wall panels without any on-site measurement or cutting.

4. The system to create a lightweight elevator interior of claim 1, further comprising:

base trim;

the base trim placed between the collection of individual wall panels and the floor of the elevator cab;

the base trim placed against a cab wall interior surface;

reveal trim;

the reveal trim placed two of the collection of individual wall panels;

the reveal trim placed against the cab wall interior surface, and partially beneath two of the collection of individual wall panels;

whereby the base trim and the reveal trim are what a user sees when gazing between tow individual wall panels of the collection of individual wall panels.

5. The system to create a lightweight elevator interior of claim 4, further comprising:

a ceiling structure that supports one or more ceiling panels;

the one or more ceiling panels including an escape hatch pass-through;

the ceiling structure connected to a ceiling of the elevator cab using one or more hinges;

the ceiling structure removably latching to the ceiling using one or more latches, a user able to release the one or more latches, allowing the ceiling structure to rotate downward for installation and service.

6. A lightweight elevator interior for installation against a cab wall interior surface of an elevator cab, the elevator cab including a floor, walls, and corners, the lightweight elevator interior comprising:

one or more wall panels;

each wall panel including an outer surface and an inner surface;

the one or more wall panels for permanent installation directly against the cab wall interior surface;

two or more temporary spacers;

the two or more temporary spacers helping an installer to place each wall panel of the one or more wall panels in a correct location with respect to the floor and corners of the elevator cab;

whereby the installer places the two or more temporary spacers against the floor and corners of the elevator cab, affixes the one or more wall panels, and then removes the two or more temporary spacers.

7. The lightweight elevator interior of claim 6, further comprising:

a ceiling structure that supports one or more ceiling panels;

the one or more ceiling panels including an escape hatch pass-through;

the ceiling structure connected to a ceiling of the elevator cab using one or more hinges;

the ceiling structure removably latching to the ceiling using one or more latches, a user able to release the one or more latches, allowing the ceiling structure to rotate downward for installation and service.

8. The lightweight elevator interior of claim 6, wherein each wall panel consists of:

a layer of plastic with a front face and back face;

a layer of laminate affixed to the front face;

a layer of double-sided adhesive affixed to the back face;

whereby each wall panel is cut-to-size, in advance, to fit the elevator cab.

9. The lightweight elevator interior of claim 6, wherein the one or more wall panels are each cut-to-size in advance, before shipment to a location of the elevator cab, thus allowing an installer to place the one or more wall panels without any on-site measurement or cutting.

10. The lightweight elevator interior of claim 6, further comprising:

base trim;

the base trim placed between the one or more wall panels and the floor of the elevator cab;

the base trim placed against the cab wall interior surface;

reveal trim;

the reveal trim placed between two of the one or more wall panels;

the reveal trim placed against the cab wall interior surface, and partially beneath two of the one or more wall panels;

whereby the base trim and the reveal trim are what a user sees when gazing between the one or more wall panels.

11. A method of installing a lightweight elevator interior comprising the steps of:

placing a base spacer an interior surface of an elevator cab and against a floor of the elevator cab;

placing a reveal spacer against a corner of the elevator cab;

installing a lower wall panel by exposing double-sided adhesive on a rear of the lower wall panel, resting the lower wall panel against the base spacer and the reveal spacer, and pressing the lower wall panel against the interior surface;

placing a handrail spacer above the lower wall panel;

installing an upper wall panel by exposing double-sided adhesive on a rear of the upper wall panel, resting the upper wall panel against the base spacer and the reveal spacer, and pressing the upper wall panel against the interior surface;

removing the reveal spacer and handrail spacer, replacing the reveal spacer against the lower wall panel and upper wall panel; and repeating the steps of installing the lower wall panel, placing the handrail spacer, installing an upper wall panel, and removing the reveal spacer and handrail spacer, until the lightweight elevator interior is complete.

12. A method of installing a lightweight elevator interior of claim 11, further the steps of:

installing a ceiling structure that supports one or more ceiling panels;

the one or more ceiling panels including an escape hatch pass-through;

hanging the ceiling structure by connecting a hinge pin on the ceiling structure to a hinge clip on an elevator cab ceiling;

installing lighting into the one or more ceiling panels; and rotating the ceiling structure upward into final position by connecting a pin on the ceiling structure to a catch on the elevator cab ceiling.

13. A method of installing a lightweight elevator interior of claim 11, wherein the upper wall panel and the lower wall panel each consist of:

a layer of plastic with a front face and back face;

a layer of laminate affixed to the front face;

a layer of double-sided adhesive affixed to the back face;

whereby the upper wall panel and the lower wall panel are cut-to-size, in advance, to fit the elevator cab.

14. A method of installing a lightweight elevator interior of claim 11, further comprising the steps of:

installing base trim by exposing double-sided adhesive on a rear of the lower wall panel, resting the base trim against the floor of the elevator cab, and pressing the base trim against the interior surface;

installing reveal trim by exposing double-sided adhesive on a rear of the lower wall panel, resting the reveal trim against a corner of the elevator cab, and pressing the reveal trim against the interior surface;

whereby the base trim and the reveal trim are what a user sees when gazing between two or more lower wall panels.

* * * * *